US007362294B2

(12) United States Patent
Liang et al.

(10) Patent No.: US 7,362,294 B2
(45) Date of Patent: Apr. 22, 2008

(54) LOW POWER LCD WITH GRAY SHADE DRIVING SCHEME

(75) Inventors: Jemm Y. Liang, San Jose, CA (US); Peter Xiao, San Jose, CA (US); Juan Shih-Hsin, Junghe (TW)

(73) Assignee: JPS Group Holdings, Ltd, Tortola (VG)

( * ) Notice: Subject to any disclaimer, the term of this patent is extended or adjusted under 35 U.S.C. 154(b) by 485 days.

(21) Appl. No.: 10/256,687

(22) Filed: Sep. 27, 2002

(65) Prior Publication Data

US 2003/0034946 A1 Feb. 20, 2003

Related U.S. Application Data

(63) Continuation-in-part of application No. 09/560,279, filed on Apr. 26, 2000, now abandoned.

(60) Provisional application No. 60/374,263, filed on Apr. 18, 2002.

(51) Int. Cl.
*G09G 3/36* (2006.01)

(52) U.S. Cl. ..... 345/89; 345/94; 345/95

(58) Field of Classification Search ..... 345/89, 345/87, 94–96, 99, 100, 204, 208–210, 690–693; 348/790–793

See application file for complete search history.

(56) References Cited

U.S. PATENT DOCUMENTS

| | | | | |
|---|---|---|---|---|
| 3,976,362 A | | 8/1976 | Kawakami | |
| 4,709,995 A | * | 12/1987 | Kuribayashi et al. | 345/89 |
| 4,929,058 A | * | 5/1990 | Numao | 345/89 |
| 5,262,881 A | | 11/1993 | Kuwata et al. | |
| 5,508,716 A | | 4/1996 | Prince et al. | |
| 5,745,089 A | | 4/1998 | Taguchi et al. | |
| 5,959,602 A | | 9/1999 | Welzen | |
| 6,252,573 B1 | * | 6/2001 | Ito et al. | 345/100 |
| 6,340,964 B1 | | 1/2002 | Nakazawa et al. | |

FOREIGN PATENT DOCUMENTS

| | | |
|---|---|---|
| DE | 4022866 | 1/1991 |
| DE | 4022866 A1 * | 1/1991 |
| EP | 0945844 A | 9/1999 |

(Continued)

OTHER PUBLICATIONS

"Notification of Transmittal of the International Search Report or the Declaration" corresponding PCT application PCT/US03/12039, International Searching Authority European Patent Office, Dec. 11, 2003, 7 pages.

(Continued)

*Primary Examiner*—Regina Liang
(74) *Attorney, Agent, or Firm*—Davis Wright Tremaine LLP

(57) ABSTRACT

In a passive liquid crystal display, frames or fields are displayed for different time periods to achieve gray scale. The voltage pulses applied to the column electrodes have substantially constant values during row scanning periods or field scanning periods to reduce power consumption. The lines of the display may be divided into odd and even fields in an interlaced configuration to suppress flicker and to further reduce power consumption by reducing frame rate.

74 Claims, 5 Drawing Sheets

FOREIGN PATENT DOCUMENTS

| | | | |
|---|---|---|---|
| EP | 0945844 | A2 * | 9/1999 |
| JP | 07064512 | | 3/1995 |
| WO | WO 98/32116 | | 7/1998 |
| WO | WO 01/82284 | | 11/2001 |
| WO | WO 02/07141 | | 1/2002 |
| WO | WO03/090192 | | 10/2003 |
| WO | WO 02/07141 | A1 * | 1/2004 |

OTHER PUBLICATIONS

Alt and Pleshko, "Scanning Limitations of Liquid—Crystal Displays," *IEEE Transactions on Electron Devices*, vol. ED-21, No. 2, pp. 146-155, Feb. 1974.

Nehring and Kmetz, "Ultimate Limits for Matrix Addressing of RMS-Responding Liquid Crystal Displays," *IEEE Transactions on Electron Devices*, vol. ED-26, No. 5, pp. 795-802, May 1979.

Scheffer and Nehring, "STN Displays and Active Addressing," electronicAsia 99, Display Technology Symposium, pp. 1-37, Oct. 14-15, 1999 Hong Kong.

"Notification of Transmittal of the International Search Report or the Declaration" corresponding PCT application PCT/US01/12989, International Searching Authority European Patent Office, Oct. 8, 2001, 7 pages.

The Patent Office of the People's Republic of China, "Notification of the First Office Action, " mailed in related Chinese Application No. 03811166.7 on Jun. 15, 2007, 32 pages (including claims).

Taiwanese Intellectula Property Office, "Office Action, " mailed in related Taiwanese Patent Application No. 92108964 on Aug. 18, 2006, 31 pages ( including translation and claims).

* cited by examiner

140

142

| | A | B | C | D | E | | |
|---|---|---|---|---|---|---|---|
| D | 7 | 9 | 11 | 12 | 13 | | |
| 0 | | | | | | 0 | |
| 1 | 1 | | | | | 7 | 7 |
| 2 | | | | 1 | | 12 | 5 |
| 3 | 1 | 1 | | | | 16 | 4 |
| 4 | 1 | | | 1 | | 19 | 3 |
| 5 | | 1 | | 1 | | 21 | 2 |
| 6 | | | 1 | 1 | | 23 | 2 |
| 7 | | | | 1 | 1 | 25 | 2 |
| 8 | 1 | 1 | 1 | | | 27 | 2 |
| 9 | 1 | 1 | | | 1 | 29 | 2 |
| 10 | 1 | | 1 | | 1 | 31 | 2 |
| 11 | | 1 | 1 | | 1 | 33 | 2 |
| 12 | | | 1 | 1 | 1 | 36 | 3 |
| 13 | 1 | 1 | 1 | | 1 | 40 | 4 |
| 14 | | 1 | 1 | 1 | 1 | 45 | 5 |
| 15 | 1 | 1 | 1 | 1 | 1 | 52 | 7 |

Frame Seq.

| | |
|---|---|
| A | E |
| E | O |
| B | E |
| C | O |
| D | E |
| A | O |
| E | E |
| B | O |
| C | E |
| D | O |
| A | E |
| E | O |
| B | E |
| C | O |
| D | E |
| A | O |
| E | E |

152

150

154

| | A | B | C | D | E | | |
|---|---|---|---|---|---|---|---|
| D | 6 | 9 | 11 | 12 | 13 | | |
| 0 | | | | | | 0 | |
| 1 | 0.5 | | | | | 3 | 3 |
| 2 | 1 | | | | | 6 | 3 |
| 3 | | 1 | | | | 9 | 3 |
| 4 | | | 1 | | | 11 | 2 |
| 5 | | | | | 1 | 13 | 2 |
| 6 | 1 | 1 | | | | 15 | 2 |
| 7 | 1 | | 1 | | | 17 | 2 |
| 8 | 1 | | | 1 | | 18 | 1 |
| 9 | 1 | | | | 1 | 19 | 1 |
| 10 | | 1 | 1 | | | 20 | 1 |
| 11 | | 1 | | 1 | | 21 | 1 |
| 12 | | 1 | | | 1 | 22 | 1 |
| 13 | | | 1 | 1 | | 23 | 1 |
| 14 | | | 1 | | 1 | 24 | 1 |
| 15 | | | | 1 | 1 | 25 | 1 |
| 16 | 1 | 1 | 1 | | | 26 | 1 |
| 17 | 1 | 1 | | 1 | | 27 | 1 |
| 18 | 1 | 1 | | | 1 | 28 | 1 |
| 19 | 1 | | 1 | 1 | | 29 | 1 |
| 20 | 1 | | 1 | | 1 | 30 | 1 |
| 21 | 1 | | | 1 | 1 | 31 | 1 |
| 22 | | 1 | 1 | 1 | | 32 | 1 |
| 23 | | 1 | 1 | | 1 | 33 | 1 |
| 24 | | 1 | | 1 | 1 | 34 | 1 |
| 25 | | | 1 | 1 | 1 | 36 | 2 |
| 26 | 1 | 1 | 1 | 1 | | 38 | 2 |
| 27 | 1 | 1 | | 1 | 1 | 40 | 2 |
| 28 | 1 | | 1 | 1 | 1 | 42 | 2 |
| 29 | | 1 | 1 | 1 | 1 | 45 | 3 |
| 30 | 0.5 | 1 | 1 | 1 | 1 | 48 | 3 |
| 31 | 1 | 1 | 1 | 1 | 1 | 51 | 3 |

Frame Seq.

| | |
|---|---|
| A | E |
| E | O |
| B | E |
| C | O |
| D | E |
| A | O |
| E | E |
| B | O |
| C | E |
| D | O |
| A | E |
| E | O |
| B | E |
| C | O |
| D | E |
| A | O |
| E | E |
| B | O |
| C | E |
| D | O |

LOW POWER LCD WITH GRAY SHADE DRIVING SCHEME

CROSS-REFERENCE TO RELATED APPLICATION

This application is a continuation-in-part of U.S. patent application Ser. No. 09/560,279 filed Apr. 26, 2000, now abandoned; this application also claims the benefit of U.S. Provisional Patent Application No. 60/374,263 filed Apr. 18, 2002. Both applications are incorporated herein in their entirety by reference.

BACKGROUND OF THE INVENTION

This invention relates in general to a system for displaying information on liquid crystal display (LCD) devices, and in particular, to low power LCD with gray shade driving scheme.

Liquid crystal displays are used in a variety of devices such as cell phones, pagers, and personal digital assistant devices. Since many of the uses of these displays are in portable, battery operated devices, low power consumption is an important display attribute. Many prior art systems, such as LCD displays, include circuitry to provide power to the display through row and column electrodes whose overlapping regions form pixels. Information to be displayed is converted into row addressing and column data signals according to one of a variety of techniques. These techniques work within the physical limitations and specifications of the LCD material by providing the appropriate signals to the display electrodes.

Typical for use in passive LCD displays are multiplexing techniques that are based on the principle that the optical properties of the display respond to root mean square (R.M.S.) signals applied to each individual pixel. Common implementations of this technique, such as the Alto-Pleshko Technique, use row signals to select rows for receiving information and the column signals as data signals to carry information to be presented. Variations of this technique have been developed to drive displays using alternating current (AC) to limit direct current (DC) damage to liquid crystals, and to keep the applied voltages within certain ranges. This variation of display technology is exemplified by the Improved Alt and Pleshko Technique (IAPT). In addition to the IAPT approach to controlling displays, there are many other schemes that can be applied in conjunction with the basic IAPT techniques for generating gray shades in the displays, such as frame rate modulation (FRM) and pulse width modulation (PWM) for producing multiple gray levels. Specifically, prior art techniques limit scanning to certain set patterns by scanning rows consecutively from one edge of the display to the opposite edge.

It has been a continuing goal of LCD display development to reduce power requirements, allowing, for example, for prolonged battery lifetime in portable devices. Among the approaches that have been attempted to reduce the power requirement are: development of new crystals, the incorporation of more advanced electronics into the display, and developing computationally intensive display driver algorithms, such as MLA techniques. The present invention introduces a new, low-power LCD panel addressing scheme that uses simple driving algorithms and that is compatible with existing liquid crystal materials and LCD manufacturing technology.

Referring to FIG. 1, a typical configuration of passive LCD and its driving waveform is illustrated. As demonstrated in the LCD panel 10 of FIG. 1, panel 10 includes an array 12 of N elongated row electrodes and an array 14 of M elongated column electrodes, where N, M are positive integers. The two arrays of electrodes are arranged transverse to one another so that each row electrode intersects and overlaps each column electrode at an overlapping area, where the overlapping area when viewed in a viewing direction by a viewer (such as the direction 16 perpendicular and into the plane of the paper in FIG. 1) defines a pixel, such as pixels 18 as shown in FIG. 1. The row and column electrodes are driven by circuits 22, 24 as shown. Following the convention of the industry, row and column electrodes are also referred to below as COM and SEG electrodes respectively, the selection (addressing) and data signals applied thereto referred to as below the COM and SEG signals or pulses respectively, and circuits 22, 24 are also known as row (COM) and column (SEG) drivers respectively.

When the driver 22 applies voltages or electrical potentials to the COM electrodes, a voltage is applied to each of the row electrodes for a time period referred to below as the row scanning or addressing period, or line period. The voltages or potentials are applied to the row electrodes at a frequency or rate referred to below as the line rate or the row scanning or addressing rate. When a voltage of "non-scanning" value is applied to a row electrode that is selected for addressing, no image will be displayed in the pixels overlapping such row electrode irrespective of the values of the voltages applied to the SEG electrodes, and when a voltage of "scanning" value is applied to a selected row electrode for addressing, a line of an image will be displayed in the pixels overlapping such row electrode. By applying scanning voltages to the N row electrodes sequentially while appropriate data SEG pulses are applied to the column electrodes, line images are displayed forming a full image comprising multiple lines.

To enhance the content of an information display, it is generally desirable to produce multiple gray levels in the display. Such gray shades are generally achieved by two conventional methods in STN (Super Twisted Neumetic): pulse width modulation and frame modulation.

In a pulse width modulation (PWM) scheme, within each line period, the SEG pulses are modulated such that for x % of the line period the SEG output level is at voltage V1, and for the rest of the (100−x) % of the line cycle, the SEG driver output level is at a lower voltage V0, and the resulting $V_{RMS}$ across the pixel electrode will have a value approaching x % of the voltage difference between the V0 and V1 above V0.

In a conventional type of frame rate modulation (FRM), multiple frames with different gradations of gray shades are grouped together as a set, where the frames are applied for the same line period, and the signals are distributed over the entire set to produce the final shading through the root mean square (RMS) averaging effect of STN. For example, a set may consist of 15 frames. Then for levels 0~15, the data can be distributed over this set of 15 frames and achieve the gray shading effect.

Both of these conventional scheme consume significant power. In the case of Pulse Width Modulation, first consider a case where the whole screen is to display a constant 50% shading. This would result in the SEG toggling at twice the line rate (ON-OFF-ON-OFF) and consume very significant power due to the capacitor loading effect on the SEG electrodes. Due to this very high toggle rate and power consumption, PWM scheme generally experience high fluctuation of power consumption, and can cause problems in system design.

As for Frame Rate Modulation, the RMS effect of STN has a bandwidth limit. In order to minimize the visible flicker, the full set of frames needs to be repeated faster than 60 Hz, which is the threshold of human flicker detection. For example, to produce 16 shades, a set of 16 frames are required, and the full frame need to be repeated at 60×16=960 fps (frames-per-second). Although spatial dithering (such as 2×2 matrix) can be used to reduce that frequency by up to ¼, but 240 fps is still significantly higher the 60 Hz which is typical for pure black and white (B/W) STN LCD (i.e. without gray shade), and therefore would consume almost four times of the power consumed by pure black and white (B/W) STN LCDs.

Another short coming of the conventional Frame Rate Modulation scheme is the resulting shading is linearly spaced between V0 and V1, where the STN LC material always has a S shaped $V_{RMS}$ to transmittance curve as illustrated in FIG. 4. Linearly spaced modulations cause gray shades at the two end of the spectrum (level 1~4, and level 13~16) to become indistinguishable from one another. In order to accomplish such curve compensation, significantly higher than 16 frames will be required. And the power consumption can increase very significantly.

Another aspect of the present invention is related to the more modem LCD control scheme such as Scheffer's Active Addressing, or Multi-Line-Addressing, where more than one row of pixels is being addressed during each line period. For example in a typical configuration of MLS with L=4, four rows of pixels are addressed simultaneously, and each SEG signal will need to be calculated based on the desired states of the four rows of pixels. If the PWM scheme is used, then each line period can be further divided into 5 subperiods, depending on where each of the four pixels will need to transition in order to achieve the desired shades. This can increase the amount of SEG switching activity by 5 times, and practically rendered PWM impractical for any system employing the MLS driving scheme. It is therefore very desirable to find a new gray shade scheme where the SEG signal will remain constant during each line period, while achieving desirable $V_{RMS}$ modulation to produce the desirable gray shades.

None of the above-described LCD driving schemes are entirely satisfactory. It is therefore desirable to provide improved LCD driving schemes for producing gray shades with minimum increases of power consumption as compared to pure black and white LCDs. It is also desirable to provide a driving scheme for suppressing flicker with further reduction in power consumption.

SUMMARY OF THE INVENTION

In consideration of the above power consumption consideration, a new scheme is devised which will allow a STN LCD to produce gray shades with minimum increase of power consumption as compared to B/W LCD. In another aspect of the invention, the new scheme will also produce a compensation effect to counteract the Liquid Crystal material's intrinsic transition curve and produce clearly distinguishable shades. In addition, an interlaced-like frame modulation scheme is introduced to further suppress flicker, and therefore allow further reduction of the minimum frame rate for saving power. The various different aspects of the invention described herein may be used individually or in combination.

In conventional driving schemes such as the pulse width modulation scheme or the frame modulation scheme, the row scanning or addressing period remains the same throughout. In the pulse width modulation scheme, for example, the SEG pulses applied to the column electrodes are modulated while the COM pulses applied to the row electrodes have substantially the same widths which are unmodulated. Gray shading is achieved in pulse width modulation by modulating the SEG output level during the row scanning period. In frame modulation, row scanning or addressing period also remains constant, and gray shading is achieved by scanning the LCD at a significantly higher frame rate than B/W display, and then selectively sending ON voltage to SEG during certain frames while sending OFF voltage to SEG during other frames.

This invention is based on the observation that, by applying electrical potentials or voltages to the row and column electrodes so that repetitive frames or fields are displayed for different time periods, gray shading can be achieved without significantly increasing power consumption. In the preferred embodiment, each of the repetitive frames or fields has a corresponding row electrode addressing period during which a row selection potential is applied to the selected one of the row electrodes for displaying an image at a line of pixels overlapping the selected row electrode. The potentials are applied so that at least two of the repetitive frames or fields have different row electrode addressing periods. A frame is the total number of lines in the displayed image, and is used interchangeably with the term "displayed image." A field is a collection of lines in the displayed image, where the collection of lines is a subset of and contains fewer than the lines that form the displayed image.

In various different embodiments, the values of row electrode addressing periods of repetitive frames or fields form integer ratios relative to each other, such as 2:1:2, 2:3:4, 6:9:11:12:13, 3:4:5:6, and 7:9:11:12:13. Using row electrode addressing periods of such values, gray shades ranging from 4 to 32 levels can be achieved. Preferably, during each of the row electrode addressing periods, the voltages or electrical potentials applied to the column (SEG) electrodes remain substantially constant. In this manner, unlike PWM, excessive SEG toggling is avoided and excessive power consumption due to capacitive loading on the SEG or column electrodes is avoided. Furthermore, such aspect of the invention can substantially reduce the need to increase the line rate or the row scanning or addressing rates, unlike the conventional frame modulation scheme. This again avoids the need to significantly increase power consumption.

Preferably the row electrode addressing periods of at least three of the repetitive frames or fields have different row electrode addressing periods and form integer ratios relative to each other, and when the values of row electrode addressing periods of the at least three different repetitive frames or fields are arranged in a sequence in ascending (i.e. increasing) order, a difference between each pair of adjacent values at or near the end of the sequence is preferably substantially equal to a maximum common denominator of the values.

Furthermore, when values of row electrode addressing periods of at least three different repetitive frames or fields are arranged in a sequence in ascending order, a value at or near the beginning of the sequence is preferably more than about 1/2.5 times a value at or near the end of the sequence. In other words, a ratio between a value at or near the beginning of the sequence to a value at or near the end of the sequence is preferably more than about 1/2.5; and a ratio between a value at or near the end of the sequence to a value at or near the beginning of the sequence is preferably smaller than about 2.5. Still more preferably, a value at or near the end of such sequence is preferably less than about 2.2 or even 2 times a value at or near the beginning of the sequence.

In addition, when values of row electrode addressing periods of at least three different repetitive frames or fields are arranged in a sequence in ascending order, a difference between such values can be computed for each pair of adjacent values in the sequence. Preferably, the values of the periods are chosen so that such differences between pairs of adjacent values decrease from the beginning of the sequence towards the end of the sequence. More preferably, the periods are chosen so that such decrease is monotonic from the beginning of the sequence towards the end of the sequence.

Another aspect of the invention employs interlacing to suppress flicker and to reduce power consumption. The lines of the display of the passive LCD and their corresponding row electrode are divided into two or more fields. A full cycle during which each of the row electrodes in the LCD is scanned once may be divided into a corresponding number of field scanning periods. In the case where all of the lines of the display are divided into only two complementary fields (that is, the two fields together contain all the lines of the display), such as even and odd fields for example, during one field scanning period such as the even field scanning period, only the (e.g. the even numbered) electrodes or lines in such field are scanned followed by another (e.g. the odd field) field scanning period for the other field during which only the (e.g. odd numbered) row electrodes or lines in such field are scanned. Where there are more than two fields, this is continued until all of the lines in all of the fields have been addressed.

Where the two complementary fields are the odd and even fields, if the timing of the COM pulses applied during the even field is approximately at the halfway point in time between consecutive pulses of the odd field, to an observer, this effectively doubles the frame rate as observed by human eyes, which helps in suppressing flicker. Similar effects can be achieved where the full display is divided into more than two fields. Thus, where the lines of the full display are divided into three fields, for example, if each COM pulse of a field is applied at a point in time that is separated from the application of consecutive pulses of another field by time periods of ratio of 1:2 or 2:1, then the frame rate observed by an observer would be tripled for suppressing flicker. The same reasoning may be extended to situations where the full display is divided into more than three fields.

The above scheme will reduce average power. However, for the shortest line period (such as line period of 6 for the set of 6:9:11:12:13) the stress of the driver circuit can still be significantly much higher than the average loading. Such fluctuation will imply the driver electronics will need to be "over designed" slightly in order to maintain good stability. Therefore, another aspect of the invention employs further partitioning each field into several sub-sections of continuously scanned rows, and the electrode within each sub-section will be scanned with a different line period or a different sequence of line periods or rates. For example, if the overall modulation required modulating line periods of 6:13:9:12:11, then instead of scanning or addressing each electrode in the field with only one of the five line periods, a different sequence of line periods or rates may be employed for scanning the different sub-sections in the field. As an example, the first sub-section will go through 6:9:11:12:13, the second sub-section will go through 13:9:12:11:6, and the third sub-section will go through 9:12:11:6:13, etc. In this manner, the temporary stress on driver circuit caused by the fast line rate can be reduced. As another example, electrical potentials applied during the longest and shortest time periods in the sequence can be applied consecutively in time.

The various aspects of the invention are described above in the context of APT and IAPT waveform. However, these aspects are also applicable to multi-line select (MLS) and to active addressing (AA). By changing the waveform generation to MLS or AA architecture, and adopt the same Line Rate Modulation principle described herein, such modified MLS scheme can be used to generate a large number of well distinguished gray shades with minimum increase of power without resorting to the PWM scheme.

BRIEF DESCRIPTION OF THE DRAWINGS

For simplicity in description, identical components are labeled by the same numerals in this application.

DETAILED DESCRIPTION OF THE EMBODIMENTS

Figure 1:
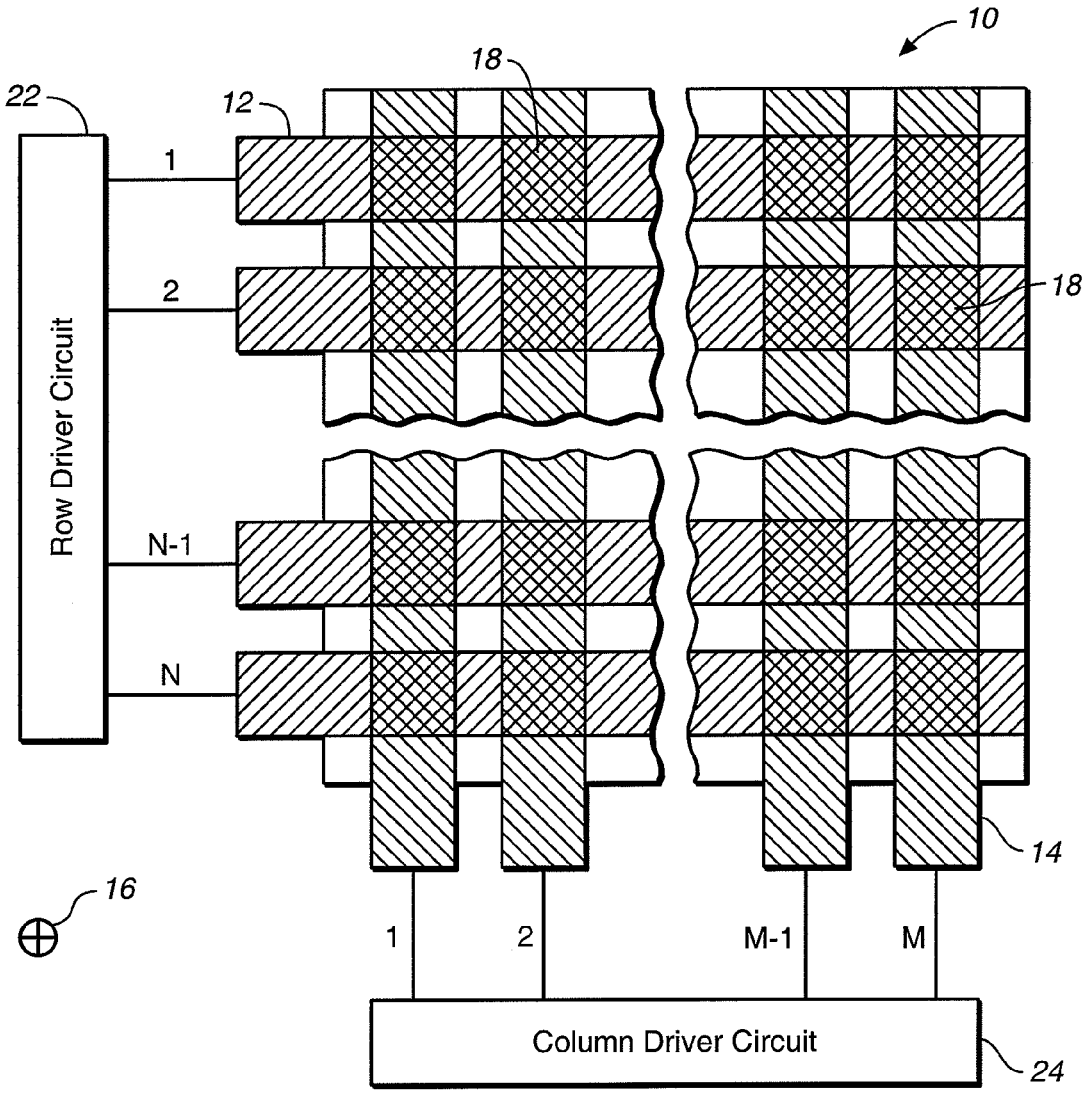
FIG. 1 (PRIOR ART)
FIG. 1 is a schematic view of a conventional LCD, illustrating the pixel geometry and the row and column drivers.

As noted above, by applying scanning or addressing voltages of actual potentials to the row electrodes for different time periods, a number of gray shades can be achieved. Embodiments 1-4 set forth below illustrate such concept.

Embodiment 1: 4-Shade Modulation:

Three frames per set:
Frame 1: 2t/line
Frame 2: 1t/line
Frame 3: 2t/line
(repeats Frame 1-2-3)

Then 4 shades can be produced by the following combination

Shade 0/5=all off
Shade 2/5=frame 1
Shade 3/5=frame 1+2
Shade 5/5=frame 1+2+3

Embodiment 2: 8-Shade Modulation:

Three frames per set:
Frame 1: 2t/line,
Frame 2: 3t/line,
Frame 3: 4t/line.
(repeats Frame 1-2-3)

Then 8 shades can be produced by the following combination

Shade 0/9=all off
Shade 2/9=frame 1
Shade 3/9=frame 2
Shade 4/9=frame 3
Shade 5/9=frame 1+2
Shade 6/9=frame 1+3
Shade 7/9=frame 2+3
Shade 9/9=frame 1+2+3

Embodiment 3: 15-Shade Modulation:

Four frames per set:
Frame 1: 3t/line,
Frame 2: 4t/line,
Frame 3: 5t/line, and
Frame 4: 6t/line.
(repeats Frame 1-2-3-4)

Then 15 shades can be produced by the following combination

Shade 0/18=all off
Shade 3/18=frame 1
Shade 4/18=frame 2
Shade 5/18=frame 3
Shade 6/18=frame 4
Shade 7/18=frame 1+2
Shade 8/18=frame 1+3
Shade 9/18=frame 2+3
Shade 10/18=frame 2+4
Shade 11/18=frame 3+4
Shade 12/18=frame 1+2+3
Shade 13/18=frame 1+2+4
Shade 14/18=frame 1+3+4
Shade 15/18=frame 2+3+4
Shade 18/18=frame 1+2+3+4

Embodiment 4: 16-Shade Modulation:

Four frames per set:
Frame A: 7t/line,
Frame B: 9t/line,
Frame C: 11t/line,
Frame D: 12t/line,
Frame E: 13t/line
(repeats Frame A-B-C-D-E)

In embodiment 1, for example, in order to achieve four different gray shades, frames of images are displayed for three row scanning or addressing periods. Since each of these periods is the time during which a certain line of the display will be on for displaying images, it is also referred to herein as the line period. Frame 1 in embodiment 1 above refers to those frames that are displayed with the row addressing or scanning time period of 2t, where t is a unit of time. Shown in abbreviation above, frame 1 is displayed for time periods of 2t/line. Then frame 2 is displayed for different time periods, such as where the row scanning or addressing time periods are t, or in the abbreviated form, t/line. A third category of frames is displayed with the same time period as the first type, namely, 2t/line. The fourth different gray shades are then achieved by the combination indicated above.

Figure 2:
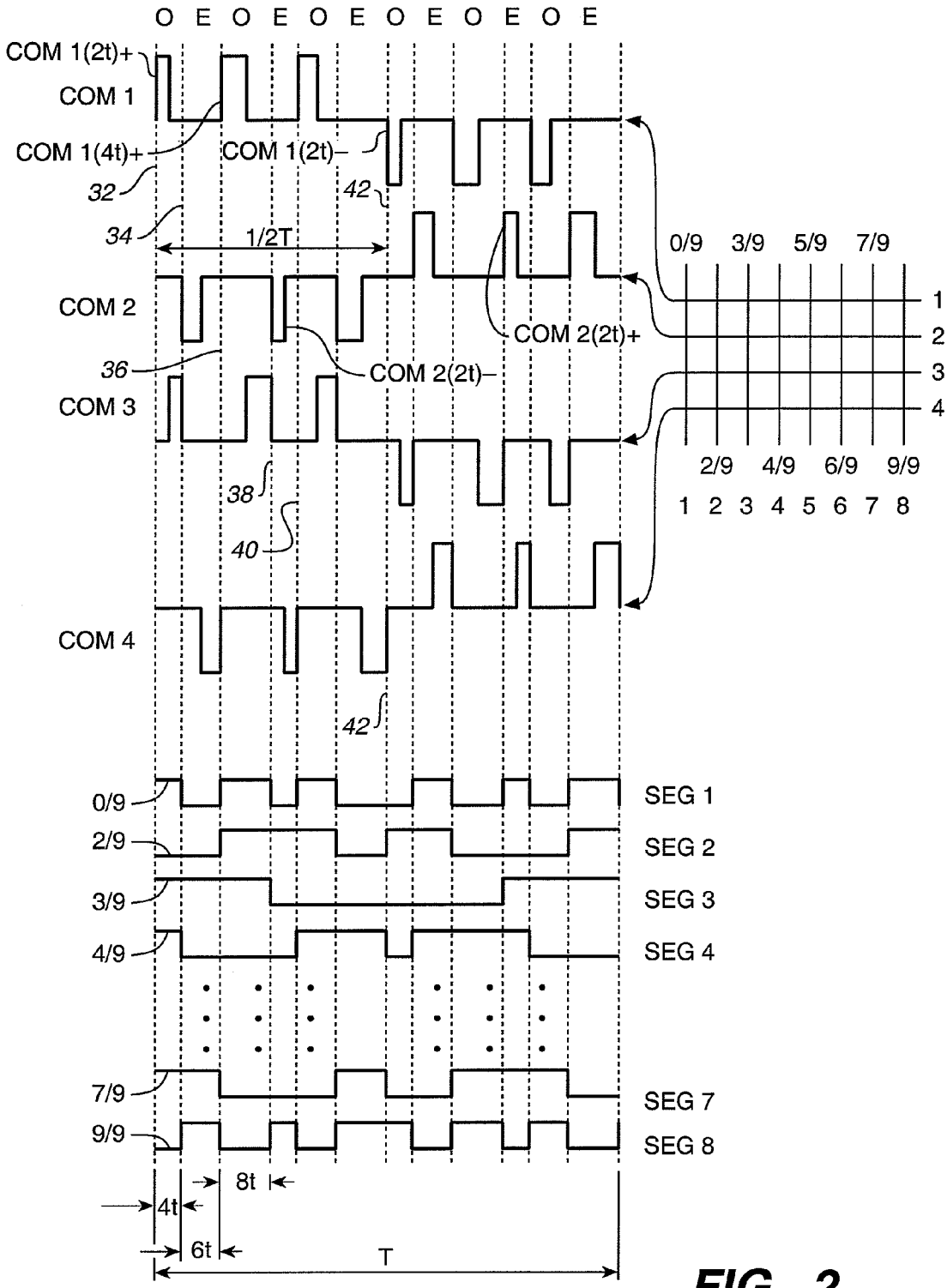
FIG. 2 is a timing diagram of the COM and SEG pulses applied to the row and column electrodes, respectively and in an interlaced manner, to illustrate various aspects of one embodiment of the invention.

The generation of the various gray shades is illustrated by embodiment 2 of FIG. 2. generating gray shades of 0/9, 2/9, 3/9, 4/9, 5/9, 6/9, 7/9, 9/9. As shown in FIG. 2, the row addressing signals have durations of 2t, 3t and 4t, and are repeated indefinitely. The SEG signals are designed to display various gray shades of 0/9 to 9/9. In order to generate the gray shade 0/9 in column 1, for example, the signal SEG1 is such that all of the four pixels in column 1 are turned off in view of the signals COM1 through COM4 (i.e. the difference between SEG1 and each of COM1 through 4 is inadequate to turn on the corresponding pixel). To generate the gray shade 2/9, for example, the SEG2 signal is such that the pixels in column 2 are turned on only during the row addressing signals with duration 2t (i.e. only frame 1 is used). For the gray shade 6/9 displayed in column 6, frames 1 and 3 are employed, meaning that the data signal SEG6 is such that the pixels in column 6 are turned on during frames 1 and 3 (when the row addressing signals are of durations 2t and 4t respectively). For the gray shade 9/9 in column 8, frames 1, 2 and 3 are employed, meaning that the data signal SEG9 is such that the corresponding pixels in column 8 are turned on during all three frames.

In an alternative embodiment to embodiment 1 above, frame 2 may be displayed for time periods that are different from t/line, such as where the row scanning or addressing time periods are X, or in the abbreviated form, X/line, where X is a positive number different from t.

To avoid flicker, each of the three types of frames is displayed at least at the human flicker detection frequency of 30 Hz. This means that, in order to achieve the four gray shades of embodiment 1, each of the three frames is displayed at 30 Hz so that the practical frame rate overall is 30 Hz×3, or 90 Hz. In embodiment 2, a three-frame set enables eight gray shades at a practical frame rate of 90 Hz.

In embodiment 3, only 4 frames are used per set to produce a set of 15 different shading, and the practical frame rate can be as low as human flicker detection frequency (30 Hz)×4=120 Hz. This is in contrast to the conventional frame modulation scheme which will require 30 Hz×15=450 Hz, which is 3.75 times the line rate for embodiment 3. Since the power consumption of a LCD is directly related to the operating frequency, such change of frequency means the power consumption will be reduced by the same ratio.

Interlacing

Unlike the conventional pulse width modulation method, the SEG signals or voltages applied to the column electrodes stay substantially unchanged during row or COM addressing or scanning time periods, such as during each of the row or COM addressing or scanning time periods. This reduces the toggling rate of signals applied to the column electrodes compared to the pulse width modulation method and reduces power consumption. As shown below, the above feature of the invention can be combined with interlacing to further improve the performance of displays.

Interlaced scanning methods can reduce the flicker significantly compared to progressive row addressing schemes that apply row scanning signals consecutively to the row electrodes, such as from row 1 to row N. In one interlaced embodiment, all of the lines of a display are divided into two fields: an odd field containing only odd lines and an even field containing only even lines, where the odd lines are displayed in odd field scanning periods and the even lines are displayed in even field scanning periods. Such interlaced embodiment may be particularly useful for devices such as mobile messaging cell phones, personal digital assistants or pagers. For example, the sequence {1,3,5, . . . } followed by the sequence {2,4,6, . . . } can sharply reduce column driver power consumption for checkerboard pattern (which is often used by various dithering algorithm to implement gray shades ) and ON-OFF stripes (which is often used to produce onscreen graphical user interface menus) while producing moderate reduction in power consumption for all other display patterns. Such an embodiment could be incorporated by using a scan sequence generator, having a fixed, nonsequential row scan sequence, such as the sequence {1,3, 5, . . . } followed by the sequence {2,4,6, . . . }. Such a series of sequences can be generated by swapping the least significant bit (LSB) and most significant bit (MSB) of a digital counter. For example a 7-bit counter is used to control a 128-row LCD. Then swapping bit-7 and bit-0 of the counter, a sequence of {0,2,4,6,8, . . . }+{1,3,5,7, . . . } is generated. Alternatively, a nonsequential row scan sequence could be built into the decoder and RAM address generator shown in FIG. 3 as described below to produce the same effect.

Obviously, the lines of the full display may be divided into more than two fields. One example would be where the display is divided into three fields with the first field including lines 1, 4, 7, . . . ; the second file including lines 2, 5, 8, . . . ; and the third field including lines 3, 6, 9, . . . . Still other manners of dividing the display into separate fields may be used and are within the scope of this invention.

In the preferred embodiment, the above-described aspects of the invention for displaying gray shades may be combined advantageously with interlacing as described below.

Embodiment 5: 8-Shade Modulation, Interlaced

Using the same 3 frames per set as used in Embodiment 2, one may change the scanning sequence from the conventional progressive (line 1 through N scanned consecutively) to 2-field-interlaced, i.e. 1-3-5-7- . . . -2-4-6-8- . . . , an interlaced addressing scheme results, and the overall frame sequence becomes:

Frame 1-Odd: 2t/line,
Frame 2-Even: 3t/line,
Frame 3-Odd: 4t/line,
Frame 1-Even: 2t/line,
Frame 2-Odd: 3t/line,
Frame 3-Even: 4t/line.
Frame 1-Odd: 2t/line,
Frame 2-Even: 3t/line,
Frame 3-Odd: 4t/line,
Frame 1-Even: 2t/line,
Frame 2-Odd: 3t/line,
Frame 3-Even: 4t/line.

By separating the frame sequence, for example, Frame 3-Even, and Frame-3-Odd, at intermixed fashion, and the overall Frame-3 is now scanned as two different group over the full 3-frame set. This essentially doubles the base-frame-rate of 30 Hz (the time required to complete 3-frame set sequentially) to 60 Hz. Interlaced scanning is thus adopted in a multi-frame modulation scheme, instead of the (1-frame) amplitude modulation.

FIG. 2 illustrates such embodiment. FIG. 2 is a timing diagram of the COM and SEG pulses applied to the row and column electrodes, respectively and in an interlaced manner, to illustrate various aspects of one embodiment of the invention. For simplicity in description, the display of FIG. 2 includes only four lines corresponding to four row or COM electrodes numbered 1 through 4. The row scanning or addressing signals or voltages that are applied to the row or COM electrodes 1-4 are labeled COM1 through COM4, respectively. For simplicity, the display of FIG. 2 includes only 8 vertical lines corresponding to 8 column or SEG electrodes numbered 1-8, where the data signals applied to the column electrodes 1-8 are SEG1 through SEG8, respectively. Obviously, more or fewer than 4 row and 8 column electrodes or lines may be used and are within the scope of the invention. Thus, during the odd field, addressing signals would be applied to row electrodes 1 and 3 for displaying lines 1 and 3 of the display, and during the even field, addressing signals would be applied to row electrodes 2 and 4 for displaying lines 2 and 4 of the display, where the lines of the two fields form the entire display.

The modified frame sequence (originating from embodiment 2) above is illustrated in FIG. 2. Thus, the scanning sequence starts with the odd field first, during which row scanning or addressing signals COM1 and COM3 are applied to row or COM electrodes 1 and 3 consecutively in time. In other words, the row scanning signal COM3 would follow the row scanning signal COM1, where both addressing signals are applied during the first odd field scanning or addressing period indicated by the horizontal distance or time period (½)T between the first two vertical dotted lines 32 and 42.

In FIG. 2, the 4 horizontal lines and the 8 vertical lines of the display are illustrated schematically on the right-hand side of the figure. It will be noted that during the first odd field addressing period between dotted lines 32 and 34, data signals SEG1 through SEG8 are applied, respectively, to the 8 column or SEG electrodes 1 through 8, respectively. The widths of each of the voltage pulses COM1 and COM3 are selected from their corresponding row scanning or addressing time periods, which are 2t, 3t and 4t. The same is true for voltage signals COM2 and COM4. In the example illustrated in FIG. 2, each of the widths of the voltage pulses COM1 and COM3 is 2t so that the odd field addressing period between dotted lines 32 and 34 is 4t. Each of the widths of the voltage pulses COM2 and COM4 is 3t so that the even field addressing period between dotted lines 34 and 36 is 6t. It will be noted from FIG. 2 that during each of the odd and even field addressing periods of 4t, 6t and 8t during the first odd field scanning or addressing period, the SEG signals or voltages applied to the column electrodes stay substantially unchanged.

As described above, unlike the conventional pulse width modulation method, the SEG signals or voltages applied to the column electrodes stay substantially unchanged during row or COM addressing or scanning time periods, such as during the row or COM addressing or scanning time period 2t of the pulse COM1(2t)+ and COM1(2t)− in FIG. 2. This reduces the toggling rate of signals applied to the column electrodes compared to the pulse width modulation method and reduces power consumption.

In fact, by maintaining the column signals at a substantially constant value during an entire odd and even field scanning or addressing time period, which can be one of 4t, 6t and 8t as illustrated in FIG. 2, the toggling rate of the column electrode data signals SEG1 through SEG8 is further reduced by a factor of 2 in an interlaced embodiment to further reduce power consumption while maintaining a desirably high frame rate, such as that of 60 Hz.

As shown in FIG. 2, the odd scanning time period between vertical dotted lines 32 and 34 is 2×2t as indicated in the table above. The next field scanning or addressing time period between vertical dotted lines 34 and 36 is for scanning the row electrodes in an even field and has the duration 2×3t. The immediately following field scanning or addressing time period is for an odd field and has the duration 2×4t between vertical dotted lines 36 and 38. The immediately following time period is an odd field addressing or scanning time period of duration 2×2t between vertical dotted lines 38 and 40 where the duration between lines 38 and 40 is again 2×2t. Thus, as is evident from FIG. 2, the set of three frames 1, 2, 3 of respective durations 2t, 3t, 4t are applied sequentially in such order: (2t/O), 3t/E, 4t/O; (2t/E), 3t/O, 4t/E, (2t/O), 3t/E, 4t/O; (2t/E), 3t/O, 4t/E . . . and therefore, as highlighted for the 2t cases, formed a perfectly interlaced pattern between even fields and odd fields.

As is known to those skilled in the art, it is preferable for the row scanning or addressing signals applied to be AC rather than DC. Therefore, for each positive voltage pulse applied to each of the four COM electrodes, a corresponding negative voltage pulse is applied. This is true for the different voltage pulses of different widths. Therefore, for each positive going voltage pulse of width 2t, for example, a negative going voltage pulse of the same width is applied. This is illustrated in FIG. 2. For example, the pulse of width 2t applied to the first row electrode, or COM1(2t)+ that is applied to row electrode 1 is balanced by a subsequent negative voltage pulse COM1(2t)−. In the same vein, as applied to row or COM electrode 2, a negative going pulse COM2(2t)− which is negative going is followed by a positive going pulse COM2(2t)+ of the same width. The same is true for the voltage pulses of widths 3t and 4t. Therefore, in the full cycle T of the row addressing signals that may be repeated indefinitely, a pair of positive and negative going pulses of the same width is applied for each of the three different widths 2t, 3t, and 4t, for a total of 6 pulses during the full cycle T, which is the cycle illustrated in FIG. 2 for each of the 4 signals COM1 through COM4.

From FIG. 2, it will be noted that the time duration between the pair of positive and negative going voltage pulses of the same width COM1(2t)+ and COM1(2t)− applied to the first row electrode COM1 are separated by a time duration substantially equal to half of the full cycle, or (½)T. It will also be evident that the corresponding pulse of the same width that is applied to the second row electrode COM2, namely, COM2(2t)−, is applied at a time that is substantially at the midpoint of such duration (½)T, between the application of pulses COM1(2t)+ and COM1(2t)−. In other words, the signal pulses that cause lines in the n different fields to be displayed for substantially the same row addressing time period during T/2 are applied so that physically adjacent pixel lines (or physically side-by-side pixel lines) in different fields are spaced apart in time by integral multiples of T/4, thereby increasing a line rate as observed by an observer For example, the time duration between the COM1 pulse edge at 32 and COM2 pulse edge at 38 is one-half (½) of the duration (½)T. This means that to an observer observing the display, the pulses of width 2t will appear to have a line rate which is double that applied to the first and second row electrodes. Thus, if the overall frame rate represented by (½)T is 30 Hz, then an observer will observe an effective line rate of 60 Hz. From FIG. 2, it will be evident that such feature is true for substantially all of the pulses of widths 2t, 3t and 4t in the 4 row addressing signals COM1 through COM4. Therefore, to an observer, these pulses will have an apparent line rate of 60 Hz, even though the actual line rate of the 4 signals COM1 through COM4 is only 30 Hz. This effectively reduces flicker and enables a reduction of the overall line rate and power consumption by the LCD.

The 8 data signals SEG1 through SEG8 are applied, respectively, to the 8 column electrodes such that each of the 8 vertical lines of the display will display a corresponding gray shade of the 8 gray shade scale. For example, as illustrated in FIG. 2, the signal SEG1 is such that the four pixels along the first vertical line will display the gray shade 0, and the signal SEG2 would cause the four pixels along the vertical line 2 to display a grade shade of 2/9 in a scale of 0-9. Similarly, signals SEG3-SEG8 are such that the four pixels along the corresponding one of the vertical lines 3-8 would display corresponding gray shades of 3/9; 4/9; 5/9; 6/9; 7/9; and 9/9 respectively.

As will be evident from FIG. 2, the odd field containing lines 1 and 3 and the even field containing lines 2 and 4 are interleaved. Where the full display is divided into three fields in the manner described above, the three different fields comprising lines 1,4,7,10, . . . ; 2,5,8,11, . . . ; 3,6,9, 12, . . . are also interleaved.

Figure 3:
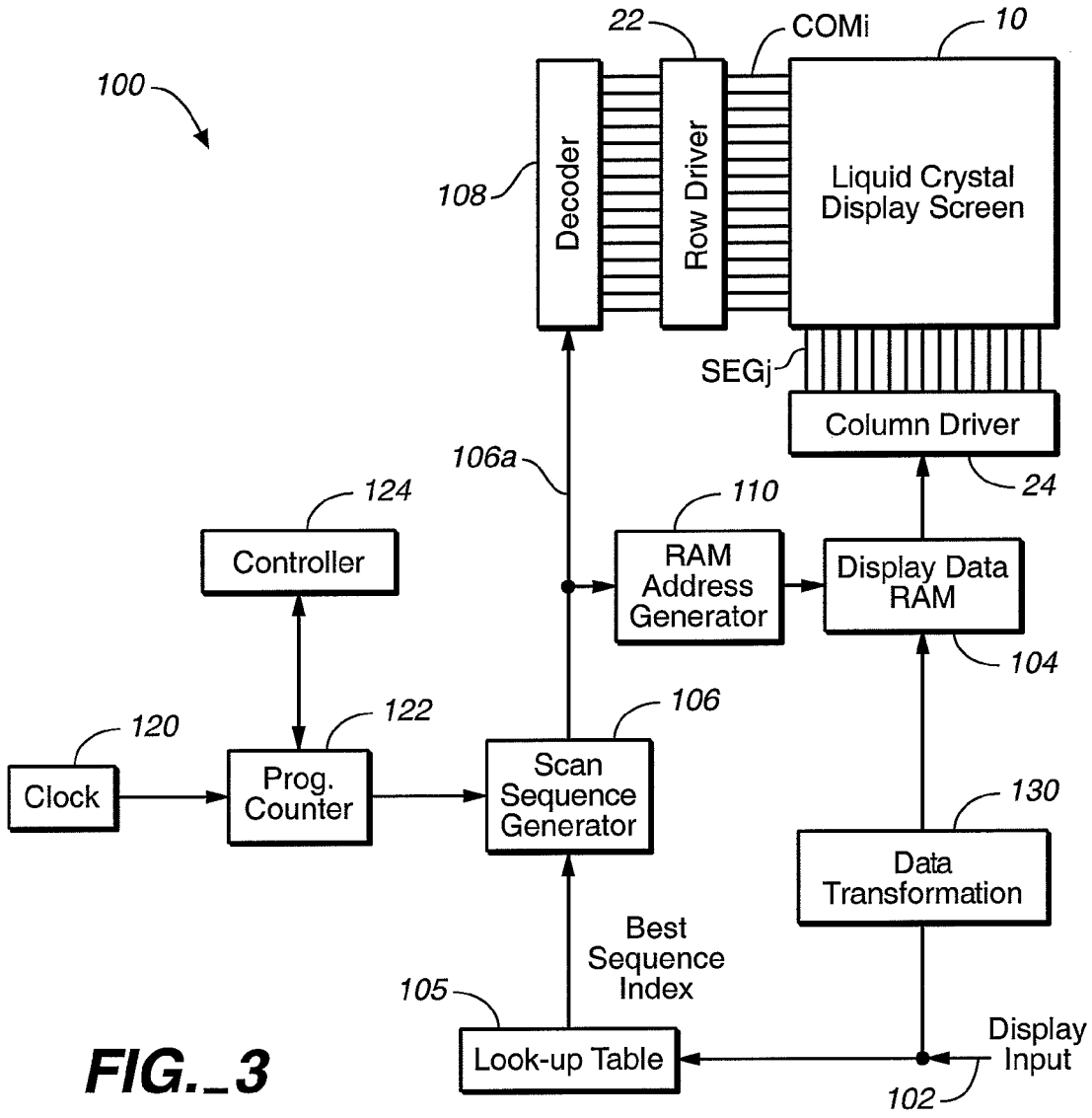
FIG. 3 is a block diagram of an LCD and its associated control and drive circuits to illustrate the invention.

FIG. 3 is a block diagram of a LCD and its associated control and drive circuits to illustrate the invention. The advantages of this invention can be achieved with a display driver capable of generating images with different row scan sequences. While other methods may allow for display of information in this way, FIG. 3 represents one such embodiment. In particular, display 100 receives a display input 102, which is stored in a display data RAM 104. It is understood that all references to display 100 include those display types discussed elsewhere in the specification, claims and figures, as well as any other display type that would operate at reduced power using sequential or nonsequential or changing row scan sequences. Display input 102 may consist of bit map information to be displayed, or may consist of a string of characters or some other higher level indication to be transformed into bit-mapped display data, including multiple layers of information for color displays. Display data 102 is stored in display data RAM 104 and held there for eventually generating column data signals SEGj, j ranging from 1 through M.

With the aid of look-up table 105, a scan sequence generator 106 controls the order in which the rows are to be scanned by generating a row scan sequence 106*a*. The row scan sequence is used to provide row addressing signals COMi, i ranging from 1 through N, by a decoder 108 that produces a plurality of signals corresponding to each row which is amplified by row driver 22 to produce the row addressing signals. The row scan sequence 106*a* also corresponds to the sequence in which display information is read from display data RAM 104, the line periods for signals to be applied to the COM electrodes, and is used to produce the corresponding column data signals SEGj. Specifically, row scan sequence SEGj is converted to display data RAM addresses by the RAM address generator 110. These addresses correspond to each of the row and column addresses for display information stored in display data RAM 104. Thus row scan sequence 106*a* is simultaneously used to generate row address signals COMi and to instruct display RAM address generator 110 to generate appropriate address signals to read from data RAM104 in order to generate the corresponding SEG signals. Typical CMOS implementation of row and column drivers 22 and 24 comprise of typical CMOS logic, multiplexer, demultiplexer, counter, level shifters, and output driver stages, all of which are well known to those who are skilled in the art of mixed mode CMOS circuit design. In order to vary the width of the voltage pulses, clock 120 supplies a clock signal to programmable counter 122 that is controlled by controller 124. The output of the programmable counter is supplied to scan sequence generator 106 so that the scan sequence generated has the appropriate time durations for the corresponding voltage pulses. All of the circuit blocks in display device 100 are controlled by controller 124. To simplify the figure, however, the connections between controller 124 and the remaining circuit blocks have been omitted, except for the connection to counter 122.

Figure 4:
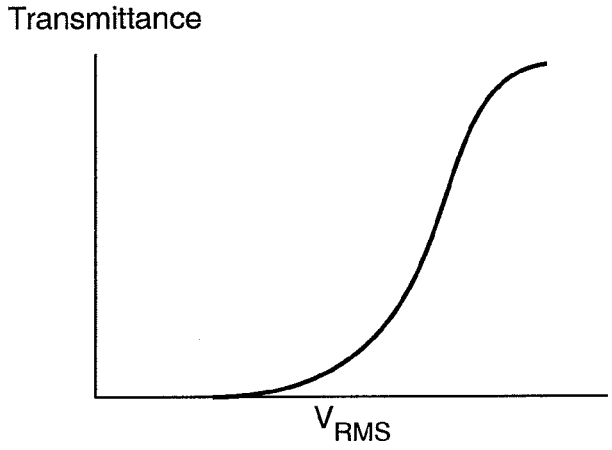
FIG. 4 is a graphical plot of the transmittance of an LCD versus the root mean square value of the voltage applied to the LCD useful for illustrating the invention.
Figures 5A, 5B, 6:
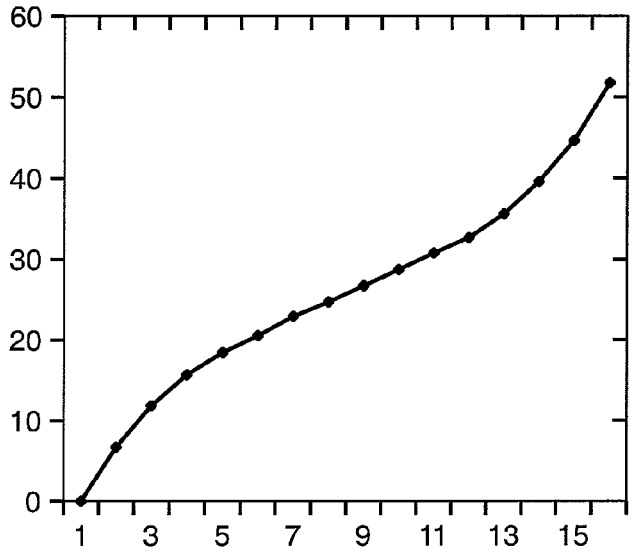
FIG. 5A is a graphical plot of a non-linear gray scale to illustrate another aspect of the invention.
FIG. 5B is a table setting forth five different row scanning periods and combinations thereof for achieving the gray scale of FIG. 5A.
FIG. 6 is a table illustrating a frame addressing sequence employing the five different row scanning periods of FIG. 5B in an interlaced scheme to illustrate aspects of the invention.

FIG. 4 is a graphical plot of the transmittance of a LCD versus the root mean square value of the voltage applied to the LCD useful for illustrating the invention. In addition to the reduced the frame rate requirement above, it is also noted that, as shown in FIG. 4, the modulation curve of a STN LCD is not linear, but has bends at the two ends of the curve. In other words, at or near the two ends of the gray scale, the transmittance of the LCD is much less sensitive to change in voltage across the liquid crystal material compared to transmittance away from the two ends. One way to compensate for such non-linearity is to apply voltage pulses for time periods that vary by uneven step sizes in a non-linear gray scale. This is illustrated by the modulation curve of FIG. 5A which is a graphical plot of a non-linear gray scale to illustrate another aspect of the invention. As shown in FIG. 5A, the modulation step size for the time periods during which voltage is applied increases as the data approaches the end points 0 or 16 of the scale, while the modulation step is smaller for the intermediate shades between data=5~11. Such curve will counter non-linear effect of the Liquid Crystal's T-V curve of FIG. 4 and has the desirable effect of expanding the visibility of the resulting modulated shades on STN.

Such curved data to Vrms mapping (similar to that illustrated in FIG. 5A) are generally achieved with PWM, or with FRM by using rather high frame rate. The mechanism in the current invention provide a way to achieve a compensated modulation curve without the need to raise the frame rate, with respect to linear modulation.

So, the 3-frame modulation in Embodiment 3 can achieve "near 60 Hz refresh rate" by actually cycling the full 3 frame-set at 30 Hz. Similarly, the 4-frame modulation in Embodiment 5 can have "near 60 Hz refresh rate" by cycling the full 4-set at 30 Hz.

In other words, such "visual flicker reduction" techniques can reduce the required operating frequency of a gray-shade STN LCD system and therefore reduce the power consumed.

It is also possible to further deduce that the above interlacing scheme can be applied where each set is partitioned into 3-sub-set of increment-by-3 scanning sequence: 1,4,7, 10, . . . , 2,5,8,11, . . . , 3,6,9,12, . . . ; or 4-sub-set of increment-by-4 scanning sequence, . . . etc.

FIG. 5B is a table setting forth five different row scanning periods and combinations thereof for achieving the gray scale of FIG. 5A. Thus, the five frames A, B, C, D, E are applied for time periods that bear the following ratio: 7:9:11:12:13. The 16 gray shades (0-15) are achieved by the combination listed in the table in FIG. 5B. Thus, to display the gray shade 8, for example, frames A, B, C are employed each for one time, for a total of 27 in arbitrary time units. The corresponding arbitrary time units for each of the 16 gray shades are listed in the right-hand column 140 of the table, where the values of the gray shades range from 0 to 52. The step size increase from one gray shade to the next in terms of time units are listed in the far right column 142 as 7, 5, 4, 3, 2, 2, 2, 2, 2, 2, 2, 3, 4, 5, 7. The values of such gray shades in arbitrary time units form the ordinate values of the points plotted in FIG. 5A.

Similar to the interlaced embodiment illustrated in FIG. 2 described above, the five frame set A-E may be applied in a similar manner as illustrated in FIG. 6. Also similar to the embodiment of FIG. 2, in the embodiment of FIG. 6, the odd or even field pulses are applied at times that are substantially halfway in time between consecutive pulses of the other field. In FIG. 6, for example, it is noted that frame D applied during the odd field at location 150 in the frame sequence is applied at a time which is halfway in time between consecutive pulses of the same frame D applied in the even field at locations 152 and 154. The same can be said for each of the frames A-D in each of the two fields.

This concept can be extended to embodiments where the lines of the display are divided into more than two fields, such as three or four fields. Thus, in reference to FIG. 2, where the display is divided into two fields, the pulse COM2(2t)− is applied halfway in time between the two pulses COM1(2t)+ and COM1(2t)−. As shown in FIG. 2, the time period between COM1(2t)+ and COM1(2t)− is ½T, where T is the duration of the full cycle. Therefore, the pulse COM2(2t)− occurs substantially at the midpoint of such time period ½T. This concept can be similarly extended to embodiments where the horizontal lines of the display are divided into four fields, in which case such pulse would occur one quarter or three quarters of the way rather than halfway between lines 32 and 42. In general, in an embodiment where the horizontal lines of the display are divided into n fields, n being an integer greater than 1, where signal pulses applied cause lines in the n different fields to be displayed for substantially the same row addressing time period during a full addressing cycle T, the application of such signal pulses to cause the display of lines in different fields are spaced apart in time by integral multiples of T/2n. This increases a line rate as observed by an observer by a factor of about n. Instead of treating the time period T as a full addressing cycle where pulses of opposite polarities are applied, the time period (½)T may be treated as a full addressing cycle, where only pulses of the same polarity are applied, as illustrated in FIG. 2.

Figures 7A, 7B, 8:
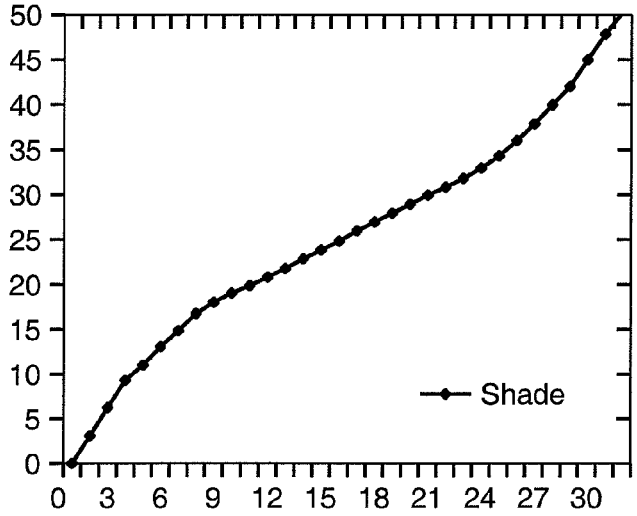
FIG. 7A is a graphical plot of another non-linear gray scale useful for illustrating the invention.
FIG. 7B is a table setting forth five different row scanning periods and the various combinations thereof for achieving the gray scale of FIG. 7A.
FIG. 8 is a table of a frame addressing sequence employing the five different row scanning periods of FIG. 7B in an interlaced scheme for illustrating various aspects of the invention.

FIG. 7A is a graphical plot of another non-linear gray scale useful for illustrating the invention. FIG. 7B is a table setting forth five different row scanning periods and the various combinations thereof for achieving the gray scale of FIG. 7A. FIG. 7A and FIG. 7B are interpreted in the same manner as those explained above for FIGS. 5A and 5B.

FIG. 8 is a table of a frame addressing sequence employing the 5 different row scanning periods of FIG. 7B in an interlaced scheme for illustrating various aspects of the invention. Similar to the scheme in FIG. 6, again it is observed that each frame displayed for each field in the sequence is applied halfway in time between consecutive pulses of the same frame in the other field.

The five frames A-E are displayed in a manner illustrated in FIG. 7B to achieve the 32 gray shades Of FIG. 7A. From FIG. 7B, it is noted that for displaying the gray shade 1 and the gray shade 0.5, frame A is displayed for only 0.5 of the time period compared to the gray shades 2, 6-9, 16-21, 26-28 and 31. In order to accomplish such feature, a data transmission block 130 is used in reference to FIG. 3. Block 130 contains an exclusive OR-gate which receives as inputs the least significant bits of the X and Y addresses of the data for displaying frame A. The output of this gate is rounded up or down so that the voltage pulse for frame A will be applied only for half of the time period.

The same COM pulse type (line period) is maintained for the entire field in the above embodiments. In the embodiment of FIG. 2, for example, addressing signals of the same line period are applied to row electrodes COM1 and COM3. In an alternative embodiment, one may further partition each field (even and odd) into groupings of smaller sets. Thus, in FIG. 2, different line periods may be employed for COM1 and COM3, and different line periods may be employed for COM2 and COM4, for example. As another example, one may further partition the odd field into: (lines 1,3,5), (lines 7,9,11), ( . . . ), and the even field into: (lines 2,4,6), (lines 8,10,12), ( . . . ), and apply different line periods during the smaller sets of the same field. In other words, the line period for lines in the second set (lines 7,9,11) of the odd field is different from that for lines in the first set (lines 1,3,5), and so on. And the line period for lines in the second set (lines 8,10,12) of the even field is different from that for lines in the first set (lines 2, 4, 6) and so on. Electrical potentials applied during the longest and shortest time periods in the sequence can be applied consecutively in time. Different sequences of line periods or rates may also be employed for scanning the different sub-sections in the field. Such faster alternation of COM line periods will mix scanning of different line periods closer together and therefore even out the higher LCD loading caused by the higher line rate.

The various aspects of the invention are described above in the context of APT and IAPT waveform. However, these aspects are also applicable to multi-line select (MLS) and to active addressing (AA). By changing the waveform generation to MLS or AA architecture, and adopt the same Line Rate Modulation principle described herein, such modified MLS scheme can be used to generate a large number of well distinguished gray shades with minimum increase of power, and without resorting to the use of PWM. In other words, the above described embodiments may be modified, so that row addressing signals may be applied to more than one row electrode at the same time in a modified MLS or AA scheme.

It is possible to employ line periods that are different from those outlined above, such as where the line periods form a exponential relationship. For example, to get 16 different gray shades, 4 repetitive frames may be used, and the line periods of the 4 frames form integer ratios bearing the relationship of 1-2-4-8. So, by combining different frames, each pixel can have a modulation of 0 through 1+2+4+8=15. Although such exponential line periods reduce the number of frames that are required, the fastest frame has a line period which is 8× faster than the slowest frame. Such big difference in line period causes the fastest frame to suffer significantly more distortion because the RC decay of the row (COM) scanning signal, and column (SEG) switching. Using the same approach, to derive at 32 equal gray shade division, 5 repetitive frames with a 1-2-4-8-16 line period ratio are required. Since passive STN display generally has significant RC delay associated in row scanning electrode, it is therefore highly desirable to find a method to produce the fine level of modulations with much less difference in line period, and therefore can minimize the distortion suffered by the faster repetitive frames.

This distortion can be avoided by the introduction of "non-exponential" frames, where several closely spaced frames are used to produce high numbers of modulation levels, with a min-max difference of line period no more than 2. In other words, if the line periods of at least three different repetitive frames are arranged in a sequence in ascending order (such as 2-3-4 and 7-9-11-12-13), a line period at or near the ends of the sequence is not more than 2 times the line periods at or near the beginning of the sequence. In the examples where the line periods form the ascending sequences 2-3-4 and 7-9-11-12-13, the last value (4 in 2-3-4 and 13 in 7-9-11-sequence is not more than 2 times the first values (i.e. 2 in 2-3-4 and 7 in 7-9-11of the line period at the beginning of the sequence. It is of course possible to employ embodiments that are variations from the above sequences by including additional line periods before 2 or 7 or after 4 or 13 in the example sequences above, while retaining the advantages described above. The above repetitive frames are preferably used to provide 4, 8, or 16 level modulations. The signals applied cause the column electrodes to be at substantially the same voltage level(s) within each line period. In other words, for frames with certain line periods, the line period of the slowest or close to the slowest frame is not more than 2 times the line period of the fastest or close to the fastest frame.

Using the above described examples of repetitive frames with line period ratios of 2-3-4, 6-9-11-12-13, 7-9-11-12-13, 3-4-5-6, about 2.2 in the example sequences) at the beginnings of the sequences is more than the line periods (4, 13, 13 and 6) at the ends of the sequences. In other words, the line periods (4, 13, 13 and 6) at the ends of the sequences are less than 2.2 times line periods (2, 6, 7 and 3 in the example sequences) at the beginnings of the sequences. For some repetitive frames (e.g. with line periods 6-9-11-12-13), more than 30 level gray shades can be produced. The signals applied cause the column electrodes to be at substantially the same voltage level(s) within each line period. Other values for the line periods may be chosen so that the line periods at the ends of the sequences are not more than about 2.5 times the line periods at the beginnings of the sequences. Such and other variations are within the scope of the invention.

In addition, when values of row electrode addressing periods of at least three different repetitive frames or fields are arranged in a sequence in ascending order, a difference between such values can be computed for each pair of adjacent values in the sequence. Preferably, the values of the periods are chosen so that such differences between pairs of adjacent values decrease from the beginning of the sequence towards the end of the sequence. More preferably, the periods are chosen so that such decrease is monotonic from the beginning of the sequence towards the end of the sequence.

In various different embodiments, the values of row electrode addressing periods of at least three repetitive frames or fields form integer ratios relative to each other to produce gray level modulations. Thus, there is a maximum common denominator between the line periods of different frame. In the examples 2-3-4, 6-9-11-12-13, 7-9-11-12-13, 3-4-5-6 above, the maximum common denominator is 1. It is noted that in all of the examples where the values of line periods are arranged in sequences of ascending order, a difference between each pair of adjacent values at or near the end of the sequence is substantially equal to a maximum common denominator of the values. In the above examples, the three slowest line periods are different by substantially the same amount of time as the maximum common denominator. The signals applied cause the column electrodes to be at substantially the same voltage level(s) within each line period.

The above described features may be implemented by means of a state machine in controller 124, which controls counter 122 and generator 106, in a manner known to those skilled in the art. Other solutions using hardware, software, firmware or a combination thereof are possible.

While the invention has been described above by reference to various embodiments, it will be understood that changes and modifications may be made without departing from the scope of the invention, which is to be defined only by the appended claims and their equivalents. All references referred to herein are incorporated by reference in their entireties.

What is claimed is:

1. A method for displaying gray shade images in a liquid crystal display, said display comprising an array of elongated row electrodes and an array of elongated column electrodes arranged transverse to the row electrodes, wherein overlapping areas of the two arrays of electrodes define pixels of the display when viewed in a viewing direction, comprising:

applying electrical potentials to the two arrays of electrodes to display different repetitive frames or fields, wherein an image is displayed by addressing the row and column electrodes during sequential row addressing time periods, and wherein during each of the row addressing time periods, a substantially constant row selection potential is applied to at least a selected one of the row electrodes for displaying an image at a line of pixels overlapping the at least one selected row electrode, each frame being the total number of lines in a displayed image of the display, and each field being a collection of lines displayed consecutively in the displayed image, wherein the collection of lines is a subset of and contains fewer than the lines that form the displayed image, at least one of said repetitive frames or fields having at least two different corresponding row electrode addressing periods for at least two corresponding sets of lines within such frame or field, thereby causing display of desired images, wherein, for displaying at least one of a number of different gray shades in the desired images, the electrical potentials are applied so that the at least two corresponding row electrode addressing periods of the at least two corresponding sets of lines of the at least one repetitive frame or field displayed are of different non-zero lengths of time.

2. The method of claim 1, each of said repetitive fields having a corresponding row electrode addressing period during which a row selection potential is applied to at least one selected row electrode for displaying an image at at least one line of pixels overlapping said at least one selected row electrode, wherein the electrical potentials are applied so that at least two of the repetitive fields have different row electrode addressing periods.

3. The method of claim 2, wherein the electrical potentials arc applied so that at least three of the repetitive fields have different row electrode addressing periods and values of row electrode addressing periods of the at least three different repetitive fields form integer ratios relative to each other.

4. The method of claim 3, wherein values of row electrode addressing periods of repetitive fields form integer ratios relative to each other of the following ratios: 2:3:4, 7:9:11:12:13, 6:9:11:12:13 or 3:4:5:6.

5. The method of claim 2, wherein the electrical potentials are applied so that at least three of the repetitive fields have different row electrode addressing periods and such fields are applied in a sequence of ascending order of their row electrode addressing periods.

6. The method of claim 2, wherein the electrical potentials are applied so that at least three of the repetitive fields have different row electrode addressing periods and such fields are applied in a sequence of ascending order of their row electrode addressing periods, so that a value at or near the end of the sequence is not more than about 2.5 times a value at or near the beginning of the sequence.

7. The method of claim 6, wherein the value at or near the end of the sequence is not more than about 2.2 times the value at or near the beginning of the sequence.

8. The method of claim 6, wherein the value at or near the end of the sequence is not more than about 2.0 times the value at or near the beginning of the sequence.

9. The method of claim 6, wherein the applying is such that images with more than 30 gray shades are displayed by the liquid crystal display.

10. The method of claim 6, wherein the applying is such that substantially the same electrical potential(s) are applied to the column electrodes during each of the row electrode addressing periods.

11. The method of claim 2, wherein the electrical potentials are applied so that at least three of the repetitive fields have different row electrode addressing periods and such fields are applied in a sequence of ascending order of their row electrode addressing periods, so that the row electrode addressing periods are such that differences between pairs of adjacent values in the sequence decrease from the beginning of the sequence towards the end of the sequence.

12. The method of claim 2, wherein said decrease of the differences between pairs of adjacent values in the sequence is monotonic from the beginning of the sequence towards the end of the sequence.

13. The method of claim 2, wherein said applying is such that 3 repetitive fields are displayed, and wherein values of row electrode addressing periods of repetitive fields form integer ratios relative to each other of the following ratios: 2:X:2, where X is a positive number, so that the application of the electrical potentials results in 4 gray shades.

14. The method of claim 2, wherein said applying is such that 3 repetitive fields are displayed, and wherein values of row electrode addressing periods of repetitive fields form integer ratios relative to each other of the following ratios: 2:3:4 so that the application of the electrical potentials results in 8 gray shades.

15. The method of claim 2, wherein said applying is such that 4 repetitive fields are displayed, and wherein values of row electrode addressing periods of repetitive fields form integer ratios relative to each other of the following ratios: 3:4:5:6 so that the application of the electrical potentials results in 15 gray shades.

16. The method of claim 2, wherein said applying is such that 5 repetitive fields are displayed, and wherein values of row electrode addressing periods of repetitive fields form integer ratios relative to each other of one of the following ratios: 7:9:11:12:13, so that the application of the electrical potentials results in 16 gray shades.

17. The method of claim 2, wherein said applying is such that 5 repetitive fields are displayed, and wherein values of row electrode addressing periods of repetitive fields form integer ratio relative to each other of 6:9:11:12:13, so that the application of the electrical potentials results in 32 gray shades.

18. The method of claim 1, said desired images comprising lines each of which corresponding to one of the row electrodes, wherein the applying causes repetitive fields to be displayed, and wherein each of at least two of the repetitive fields contains less than all of the lines of said desired images.

19. The method of claim 18, said desired images comprising lines, wherein said at least two of the repetitive fields contain complementary lines of said desired images.

20. The method of claim 18, said desired images comprising lines, wherein at least one set of three or four of the repetitive fields contain lines that together contain all the lines of said desired images.

21. The method of claim 18, wherein the applying applies electrical potentials so that lines of each of said at least two repetitive fields are displayed during a different corresponding field scanning period.

22. The method of claim 21, wherein the lines of said at least two repetitive fields are interleaved with one another.

23. The method of claim 22, wherein the lines of said at least two repetitive fields constitute all of the lines of said desired images, one of said at least two repetitive fields containing odd numbered lines and the other of said at least two repetitive fields containing even numbered lines, wherein the odd lines are displayed during odd field scanning periods and even lines are displayed during even field scanning periods.

24. The method of claim 23, wherein the applying applies to the column electrodes electrical potentials that are substantially unchanged during each of at least some of the field scanning periods.

25. The method of claim 23, wherein the applying applies electrical potentials to the row electrodes for time periods in accordance with a time sequence of different row electrode addressing periods.

26. The method of claim 25, wherein the applying applies to the row electrodes electrical potentials that of a first polarity during a first half of a full addressing cycle, and electrical potentials that of a second polarity during a second half of the full addressing cycle, in accordance with the time sequence.

27. The method of claim 25, wherein the applying applies to the row electrodes electrical potentials of opposite polarities during a full addressing cycle, and wherein electrical potentials of opposite polarities are applied for the same row electrode addressing period substantially half of a full addressing cycle apart.

28. The method of claim 25, wherein the applying is such that electrical potentials applied during the longest and shortest time periods in the sequence are applied consecutively in time with one immediately following the other.

29. The method of claim 22, wherein the at least two repetitive fields comprise n repetitive fields that in combination contain all of the lines of said desired images, n being an integer greater than 1, and the applying applies signal pulses that cause lines in the n different fields to be displayed for substantially the same row addressing time period during a full addressing cycle T or (½)T, and wherein the application of such signal pulses to cause the display of physically adjacent lines in different fields are spaced apart in time by integral multiples of T/2n, thereby increasing a line rate as observed by an observer.

30. The method of claim 22, wherein the at least two repetitive fields comprise odd and even fields, and the applying applies signal pulses that cause lines in the odd and even fields to be displayed for substantially the same row addressing time period during a full addressing cycle T or T/2, and wherein the application of such signal pulses to cause the display of physically side-by-side pixel lines in different fields are spaced apart in time by integral multiples of T/4, thereby increasing a line rate as observed by an observer.

31. The method of claim 18, wherein the lines in at least one field are divided into subsets, and the applying applies signal pulses to cause corresponding subsets of lines to be displayed, and wherein the signal pulses applied to cause the display of two different subsets of lines are applied for different row addressing time periods.

32. The method of claim 2, each of said repetitive fields having a corresponding row electrode addressing period during which a row selection potential is applied to two or more selected row electrodes for displaying an image at two or more corresponding lines of pixels overlapping said two or more selected row electrodes.

33. The method of claim 32, wherein no pulse width modulation is employed in generating the electrical potentials for displaying gray shades.

34. The method of claim 1, wherein the applying causes non-linear gray shades to be displayed.

35. The method of claim 34, wherein the gray shades are spaced apart by steps and the steps between adjacent gray shades in a gray scale are smaller for gray shades away from ends of the scale than those at or near the ends of the scale.

36. The method of claim 1, each of said repetitive fields having a plurality of corresponding row electrode addressing periods during each of which a row selection potential is applied to at least one selected row electrode for displaying an image at at least one line of pixels overlapping said at least one selected row electrode, wherein substantially the same electrical potentials are applied to the column electrodes during each of at least some of the row electrode addressing periods of at least one of said repetitive fields.

37. A method for displaying gray shade images in a liquid crystal display, said display comprising an array of elongated row and an array of elongated column electrodes arranged transverse to the row electrodes, wherein overlapping areas of the two arrays of electrodes define pixels of the display when viewed in a viewing direction, comprising:

applying electrical potentials to the two arrays of electrodes to display two or more different frames, each of the frames divided into two or more fields, thereby causing display of desired images, said desired images comprising lines corresponding to the row electrodes, wherein the electrical potentials are applied so that at least two of the fields each containing less than all the lines of said desired images are displayed repetitively, at least one of said repetitively displayed fields having at least two corresponding row electrode addressing periods for at least two corresponding sets of lines within such field, thereby causing display of desired images, wherein, for displaying at least one of a number of different gray shades in the desired images, the electrical potentials are applied so that the at least two corresponding row electrode addressing periods of the at least two corresponding sets of lines of the at least one repetitively displayed field displayed are of different non-zero lengths of time.

38. The method of claim 37, wherein said at least two of the repetitive fields contain complementary lines of said desired images.

39. The method of claim 37, wherein for displaying at least one of a number of different gray shades in the desired images the repetitive fields are displayed for different time periods.

40. The method of claim 37, wherein the applying applies electrical potentials so that lines of each of said at least two repetitive fields are displayed during a different corresponding field scanning period.

41. The method of claim 40, wherein the lines of said at least two repetitive fields from the same frame are interleaved with one another.

42. The method of claim 41, wherein the at least two repetitive fields comprise n repetitive fields that in combination contain all of the lines of said desired images, n being an integer greater than 1, and the applying applies signal pulses that cause lines in the n different fields to be displayed for substantially the same row addressing time period during a full addressing cycle T or T/2, and wherein the application of such signal pulses to cause the display of physically adjacent lines in different fields are spaced apart in time by integral multiples of T/2n, thereby increasing a line rate as observed by an observer.

43. The method of claim 41, wherein the at least two repetitive fields comprise odd and even fields, and the applying applies signal pulses that cause lines in the odd and even fields to be displayed for substantially the same row addressing time period during a full addressing cycle T/2 or T, and wherein the application of such signal pulses to cause the display of physically adjacent lines in different fields are spaced apart in time by integral multiples of T/4, thereby increasing a line rate as observed by an observer.

44. The method of claim 41, wherein the lines of said at least two repetitive fields constitute all of the lines of said desired images, one of said at least two repetitive fields containing odd numbered lines and the other of said at least two repetitive fields containing even numbered lines, wherein the odd lines are displayed during odd field scanning periods and even lines are displayed during even field scanning periods.

45. The method of claim 40, wherein the applying applies to the column electrodes electrical potentials that are substantially unchanged during each of at least some of the field scanning periods.

46. The method of claim 40, wherein the applying applies electrical potentials to the row electrodes for time periods in accordance with a time sequence of different row electrode addressing periods.

47. The method of claim 40, wherein the applying applies to the row electrodes electrical potentials that of a first polarity during a first half of a full addressing cycle, and electrical potentials that of a second polarity during a second half of the full addressing cycle, in accordance with the time sequence.

48. The method of claim 40, wherein the applying applies to the row electrodes electrical potentials of opposite polarities during a full addressing cycle, and wherein electrical potentials of opposite polarities are applied for the same row electrode addressing period substantially half of a full addressing cycle apart.

49. The method of claim 40, wherein the applying is such that electrical potentials applied during the longest and shortest time periods in the sequence are applied consecutively in time.

50. The method of claim 37, wherein at least one set of three or four of the repetitive fields contain lines that together contain all the lines of said desired images.

51. The method of claim 37, wherein the applying causes non-linear gray shades to be displayed.

52. The method of claim 51, wherein the gray shades are spaced apart by steps and the steps between adjacent gray shades in a gray scale are smaller for gray shades away from ends of the scale than those at or near the ends of the scale.

53. The method of claim 37, each of said repetitive fields having a plurality of corresponding row electrode addressing periods during each of which a row selection potential is applied to at least one selected row electrode for displaying an image at at least one line of pixel overlapping said at least one selected row electrode, wherein substantially the same electrical potentials are applied to the column electrodes during each of at least some of the row electrode addressing periods of at least one of said repetitive fields.

54. The method of claim 37, wherein the lines of said at least two repetitive fields constitute all of the lines of said desired images, one of said at least two repetitive fields containing odd numbered lines and the other of said at least two repetitive fields containing even numbered lines, wherein the odd lines are displayed during odd field scanning periods and even lines are displayed during even field scanning periods.

55. The method of claim 54, wherein the applying applies in the odd or even field pulses of electrical potentials to the row electrodes at times that each of at least some of which is substantially half way in time between consecutive pulses of the other field.

56. The method of claim 55, wherein the applying applies electrical potentials to the row electrodes for different time periods in accordance with a time sequence of different time periods.

57. The method of claim 56, wherein for each of the time periods in the sequence, the applying applies in the odd or even field pulses of electrical potentials to the row electrodes at times that each of which is substantially half way in time between consecutive pulses of the other field.

58. The method of claim 37, wherein the lines in at least one field are divided into subsets, and the applying applies signal pulses to cause corresponding subsets of lines to be displayed, and wherein the signal pulses applied to cause the display of two different subsets of lines are applied for different row addressing time periods.

59. The method of claim 37, each of said fields having a corresponding row electrode addressing period during which a row selection potential is applied to at least one selected row electrode for displaying an image at at least one line of pixels overlapping said at least one selected row electrode, wherein the electrical potentials are applied so that at least two of the fields have different row electrode addressing periods.

60. The method of claim 59, each of said fields having a corresponding row electrode addressing period during which a row selection potential is applied to two or more selected row electrodes for displaying an image at two or more corresponding lines of pixels overlapping said two or more selected row electrodes.

61. The method of claim 60, wherein no pulse width modulation is employed in generating the electrical potentials for displaying gray shades.

62. An apparatus for displaying gray shade images comprising:

a liquid crystal display comprising an array of elongated row and an array of elongated column electrodes arranged transverse to the row electrodes, wherein overlapping areas of the two arrays of electrodes define pixels of the display when viewed in a viewing direction; and a drive circuit applying electrical potentials to the two arrays of electrodes to display repetitive frames or fields, wherein an image is displayed by addressing the row and column electrodes during sequential row addressing time periods, and wherein during each of the row addressing time periods, a substantially constant row selection potential is applied to at least a selected one of the row electrodes for displaying an image at a line of pixels overlapping the at least one selected row electrode, at least one of said repetitive frames or fields having at least two corresponding row electrode addressing periods for at least two corresponding sets of lines within such frame or field, thereby causing display of desired images, each frame being the total number of lines in a desired image of the display, and each field being a collection of lines in the desired image, wherein the collection of lines is a subset of and contains fewer than the lines that form the desired image, wherein, for displaying at least one of a number of different gray shades in the desired images, the electrical potentials are applied so that the at least two corresponding row electrode addressing periods of the at least two corresponding sets of lines of the at least one repetitive frame or field displayed are for different non-zero lengths of time.

63. An apparatus for displaying gray shade images, comprising:

a liquid crystal display comprising an array of elongated row and an array of elongated column electrodes arranged transverse to the row electrodes, wherein overlapping areas of the two arrays of electrodes define pixels of the display when viewed in a viewing direction; and a drive circuit applying electrical potentials to the two arrays of electrodes to display two or more different frames, each of the frames divided into two or more fields, thereby causing display of desired images, said desired images comprising lines, wherein the electrical potentials are applied so that the two or more fields are applied for different time periods and wherein at least two of the fields each containing less than all the lines of said desired images are displayed repetitively, at least one of said repetitively displayed fields having at least two corresponding row electrode addressing periods for at least two corresponding sets of lines within such field, thereby causing display of desired images, wherein, for displaying at least one of a number of different gray shades in the desired images, the electrical potentials are applied so that the at least two corresponding row electrode addressing periods of the at least two corresponding sets of lines of the at least one repetitively displayed field are of different non-zero lengths of time.

64. A method for displaying gray shade images in a liquid crystal display, said display comprising an array of elongated row electrodes and an array of elongated column electrodes arranged transverse to the row electrodes, wherein overlapping areas of the two arrays of electrodes define pixels of the display when viewed in a viewing direction, comprising:

applying electrical potentials to the two arrays of electrodes to display different repetitive frames or fields, each repetitive frame or field having at least one corresponding row electrode addressing period, thereby causing display of desired images, each repetitive frame being the total number of lines in a desired image of the display, and each repetitive field being a collection of lines in the desired image, wherein the collection of lines is a subset of and contains fewer than the lines that form the desired image, wherein, for displaying at least one of a number of different gray shades in the desired images, the electrical potentials are applied so that the corresponding row electrode addressing periods of each of at least three of the repetitive frames or fields have different row electrode addressing periods, form integer ratios relative to each other, and such frames or fields are applied in a sequence in ascending order.

65. A method for displaying gray shade images in a liquid crystal display, said display comprising an array of elongated row electrodes and an array of elongated column electrodes arranged transverse to the row electrodes, wherein overlapping areas of the two arrays of electrodes define pixels of the display when viewed in a viewing direction, comprising:

applying electrical potentials to the two arrays of electrodes to display different repetitive frames or fields, each repetitive frame or field having a plurality of corresponding row electrode addressing periods, thereby causing display of desired images, each repetitive frame being the total number of lines in a desired image of the display, and each repetitive field being a collection of lines in the desired image, wherein the collection of lines is a subset of and contains fewer than the lines that form the desired image, wherein, for displaying at least one of a number of different gray shades in the desired images, the electrical potentials are applied so that the corresponding row electrode addressing periods of each of at least three of the repetitive frames or fields are different and such frames or fields are applied in a sequence of ascending order of their row electrode addressing periods, so that a value at or near the end of the sequence is not more than about 2.5 times a value at or near the beginning of the sequence.

66. The method of claim 65, wherein the value at or near the end of the sequence is not more than about 2.2 times the value at or near the beginning of the sequence.

67. The method of claim 66, wherein the value at or near the end of the sequence is not more than about 2.0 times the value at or near the beginning of the sequence.

68. The method of claim 65, wherein the applying is such that images with more than 30 gray shades are displayed by the liquid crystal display.

69. The method of claim 65, wherein the applying is such that substantially the same electrical potential(s) are applied to the column electrodes during each of the row electrode addressing periods.

70. The method of claim 65, wherein when the values of row electrode addressing periods of the at least three different repetitive fields are applied in a sequence in ascending order, the row electrode addressing periods are such that differences between pairs of adjacent values in the sequence decrease from the beginning of the sequence towards the end of the sequence.

71. The method of claim 70, wherein said decrease is monotonic from the beginning of the sequence towards the end of the sequence.

72. The method of claim 65, wherein a difference between each pair of adjacent values at or near the end of the sequence is substantially equal to a maximum common denominator of the values.

73. A method for displaying gray shade images in a liquid crystal display, said display comprising an array of elongated row electrodes and an array of elongated column electrodes arranged transverse to the row electrodes, wherein overlapping areas of the two arrays of electrodes define pixels of the display when viewed in a viewing direction, comprising:

applying electrical potentials to the two arrays of electrodes to display different repetitive frames or fields, each repetitive frame or field having at least one corresponding row electrode addressing period, thereby causing display of desired images, each repetitive frame being the total number of lines in a desired image of the display, and each repetitive field being a collection of lines in the desired image, wherein the collection of lines is a subset of and contains fewer than the lines that form the desired image, wherein, for displaying at least one of a number of different gray shades in the desired images, the electrical potentials are applied so that the corresponding row electrode addressing periods of each of at least three of the repetitive frames or fields have different row electrode addressing periods and form integer ratios relative to each other, and such frames or fields are applied in a sequence of ascending order of their row electrode addressing periods, so that differences between pairs of adjacent values in the sequence decrease from the beginning of the sequence towards the end of the sequence.

74. The method of claim 73, wherein said decrease is monotonic from the beginning of the sequence towards the end of the sequence.

* * * * *